US006981611B2

(12) United States Patent
Carruth et al.

(10) Patent No.: US 6,981,611 B2
(45) Date of Patent: Jan. 3, 2006

(54) TIP FOR A CAULKING GUN

(76) Inventors: Ronald Scott Carruth, 5280 Elrsoe Ave., San Jose, CA (US) 95124; Bradley George Carruth, 2410 Walnut St., Reno, NV (US) 89502; David Paul Carruth, 2410 Walnut St., Reno, NV (US) 89502; Brennen George William Carruth, 2410 Walnut St., Reno, NV (US) 89502

( * ) Notice: Subject to any disclaimer, the term of this patent is extended or adjusted under 35 U.S.C. 154(b) by 0 days.

(21) Appl. No.: 10/657,884

(22) Filed: Sep. 9, 2003

(65) Prior Publication Data

US 2005/0051571 A1 Mar. 10, 2005

(51) Int. Cl.
*B67D 7/00* (2006.01)

(52) U.S. Cl. ..... 222/1; 222/192; 222/567; 401/266; 401/193

(58) Field of Classification Search ..... 401/266, 401/193; 222/1, 192, 326, 327, 567; 425/87
See application file for complete search history.

(56) References Cited

U.S. PATENT DOCUMENTS 3,981,595 A 9/1976 Blake
4,260,273 A 4/1981 Hemperly et al.
4,806,022 A 2/1989 Takahiro
4,932,565 A 6/1990 Paradiso
5,749,498 A * 5/1998 Lavoie et al. ..... 222/192
5,865,555 A * 2/1999 Dawson ..... 401/266
5,882,133 A * 3/1999 Chao et al. ..... 401/266
5,984,557 A * 11/1999 Fennell ..... 401/193
6,464,115 B2 10/2002 Wemyss et al.
2001/0030207 A1 10/2001 Wemyss et al.

* cited by examiner

*Primary Examiner*—Michael Mar
*Assistant Examiner*—Sonia N. Khaira
(74) *Attorney, Agent, or Firm*—William H. Eilberg

(57) ABSTRACT

A caulking gun includes a tip which enables an adhesive, or other extrudable compound, to be laid down consistently, accurately, and rapidly along a base or base board or other elongated structure. The tip includes at least one guide which extends outside the plane of the surface of an outlet portion of the tip. The guide engages an edge of the base or base board, as the caulking gun is moved along the base or base board, and as the compound is extruded. As long as the guide is firmly engaged with the base or base board, the compound will be laid down consistently in neat, straight lines. In another embodiment, an attachment converts a caulking gun tip of the prior art into one having the essential features of the present invention. The invention enhances the productivity of construction personnel, and improves the quality of work, by virtually insuring that adhesives, or other compounds, are applied consistently and accurately.

8 Claims, 5 Drawing Sheets

TIP FOR A CAULKING GUN

BACKGROUND OF THE INVENTION

The present invention relates to the field of construction, and provides a device in the nature of a caulking gun, for rapid application of adhesive, or other compound, to an elongated member such as a base that is installed along the bottom of a wall.

It has been known, in the construction industry, to provide a base or base board, or its equivalent, along the bottom of the walls of a room. The base or base board serves the aesthetic function of defining an attractive border where the floor meets the wall.

In residential applications, it is common to use a base board, typically built up from a plurality of rigid elongated pieces, and defining a continuous structure extending around the periphery of the room. In commercial applications, it is more common to use a base that is not rigid, such as a rubber or synthetic rubber or vinyl structure, and to adhere the base directly to the wall. Like the case of the rigid board, the flexible base usually extends from the floor to a level that may be several inches above the floor. The present invention can be used to apply adhesive to either kind of base, but is especially intended for use in commercial installations where the base is an elongated flexible member.

The flexible base material described above must be firmly affixed to the wall, and this step is usually performed with an adhesive. The adhesive is usually applied to the base using a caulking gun or its equivalent, and the flexible base is then pressed against the wall, such that the flexible material and the wall become permanently adhered together.

A problem with the above process is that it is relatively time-consuming and difficult to apply an adhesive properly to a long length of material. Not only must the adhesive be provided along the length of the base, but the adhesive must also be distributed with reasonable uniformity over the area of the base, so that when the base is pressed against the wall, the adhesive bond will be strong.

A related and more severe problem occurs when the bead of adhesive becomes too close to the top edge of the base. When this happens, and when the base is pressed against the wall, adhesive seeps or oozes out, above the top of the base. This problem requires cleanup by the installer, and in some cases requires touch-up painting or re-application of a wall covering, such as wallpaper, to hide the glue marks left on the wall. The process of dealing with the excess adhesive that seeps above the base is very time consuming at best, and very costly at worst, and is a significant problem in the industry.

In the prior art, it has been known to apply the adhesive with a caulking gun that has been fitted with a special tip. The tip has a plurality of channels, terminating in a plurality of openings, so that adhesive ejected from a cartridge is forced through the channels and out through the openings, forming a set of parallel lines of adhesive along the base. The use of the plurality of openings addresses the need to distribute the adhesive uniformly over the surface of the base, and it also, at least theoretically, provides a solution to the problem of glue seeping out above the base.

In practice, however, it is difficult to move the caulking gun rapidly, while still maintaining the proper positioning of the lines of adhesive. If moved too quickly, the devices of the prior art are likely to produce lines of adhesive that are not straight, and the adhesive may be distributed unevenly over the base. If the topmost line of adhesive becomes too close to the top of the base, the problem of seepage will arise again. A solution to the problem is to work more slowly, but doing so reduces the productivity of the craftsperson.

The present invention provides a device for applying adhesives, or other compounds, to an elongated member, and enables construction personnel to apply the adhesive both rapidly and accurately. The invention virtually assures that the uppermost bead of glue will never be too close to the top of the base, so that seeping or oozing will not occur when the base is pressed against the wall.

The invention also enables prior art caulking devices to be easily modified to include the features of the present invention.

SUMMARY OF THE INVENTION

The present invention includes a caulking gun having a novel tip. The tip includes a shank which is connectable to a conventional cartridge containing an extrudable compound, and an outlet portion connected to the shank. The outlet portion includes internal passages that distribute the compound to a plurality of spaced-apart openings at the outlet end of the tip. The tip includes at least one guide, the guide being attached to a lateral edge of the outlet portion. The guide extends outside the plane of the surface of the outlet portion. In another preferred arrangement, the tip includes two guides, located at opposite lateral edges, and being oriented in mutually opposite directions, so that the tip can be used in either of two orientations.

The purpose of the guide is to enable the tip to engage an edge of a base to which an adhesive, or other compound, is to be applied. If the guide is held in firm engagement with the edge of the base, while the caulking gun is moved along the base, the extruded material will define generally straight, spaced-apart lines, along the entire length of the base. The user need not be concerned with aiming the compound; as long as the guide is engaged, the compound will be laid down in the desired configuration.

The invention includes a caulking gun having the tip described above, and it also includes the novel tip itself. The invention also includes the method of applying a compound to an elongated structure such as a base or a base board, the method comprising the step of moving a caulking gun along the base or base board while extruding material from the caulking gun, the above steps being performed while holding the guide of the caulking gun tip firmly against an edge of the base or base board. This method insures that the extruded compound can be consistently and rapidly laid down in neat rows. It also insures that the uppermost line of compound is spaced by a desired amount from the top edge of the base or base board.

In another embodiment, a clip-on attachment contains one or more guides of the type described above. The attachment includes clips or equivalent structures, and can be affixed to a conventional tip which lacks the guide described above. In this way, a conventional caulking tip can be effectively converted into a tip of the present invention.

The present invention therefore has the primary object of providing a device for rapidly applying an adhesive, or other extrudable compound, to an elongated structure such as a base or a base board.

The invention has the further object of providing a tip for attachment to a caulking gun, the tip facilitating the rapid and accurate application of an adhesive, or other extrudable compound, to a base or its equivalent.

The invention has the further object of providing an attachment, for affixation to a conventional caulking gun tip, to enable the caulking gun to have the features and advantages of the present invention.

The invention has the further object of providing an efficient method of applying an adhesive, or other extrudable compound, to an elongated structure such as a base or a base board.

The invention has the further object of enhancing the productivity of construction personnel, by enabling them to apply adhesives, or other compounds, very rapidly, to a base or a base board or to other elongated structures.

The invention has the further object of reducing the per unit labor costs of applying adhesives, or other compounds, to elongated structures such as a base or a base board.

The invention has the further object of enhancing the quality of work performed by construction personnel, by providing a device that accurately and consistently lays down an adhesive, or other compound, onto an elongated structure such as a base or a base board.

The reader skilled in the art will recognize other objects and advantages of the present invention, from a reading of the following brief description of the drawings, the detailed description of the invention, and the appended claims.

DETAILED DESCRIPTION OF THE INVENTION

The present invention includes a method and apparatus for applying an extrudable compound to an elongated structure such as a base or a base board. As used in this specification, the term "base" means an elongated flexible member, typically made of rubber or vinyl, that is applied to the bottom of a wall, around the periphery of a room. The term "base board" means an elongated rigid member, used for the same purpose. The present invention can be used to apply a compound either to a base or to a base board, and is especially useful in applying an adhesive to a flexible base. Thus, the teachings of this specification, with regard to a flexible base, also apply to an elongated structure in general, such as a base board.

Figure 1:
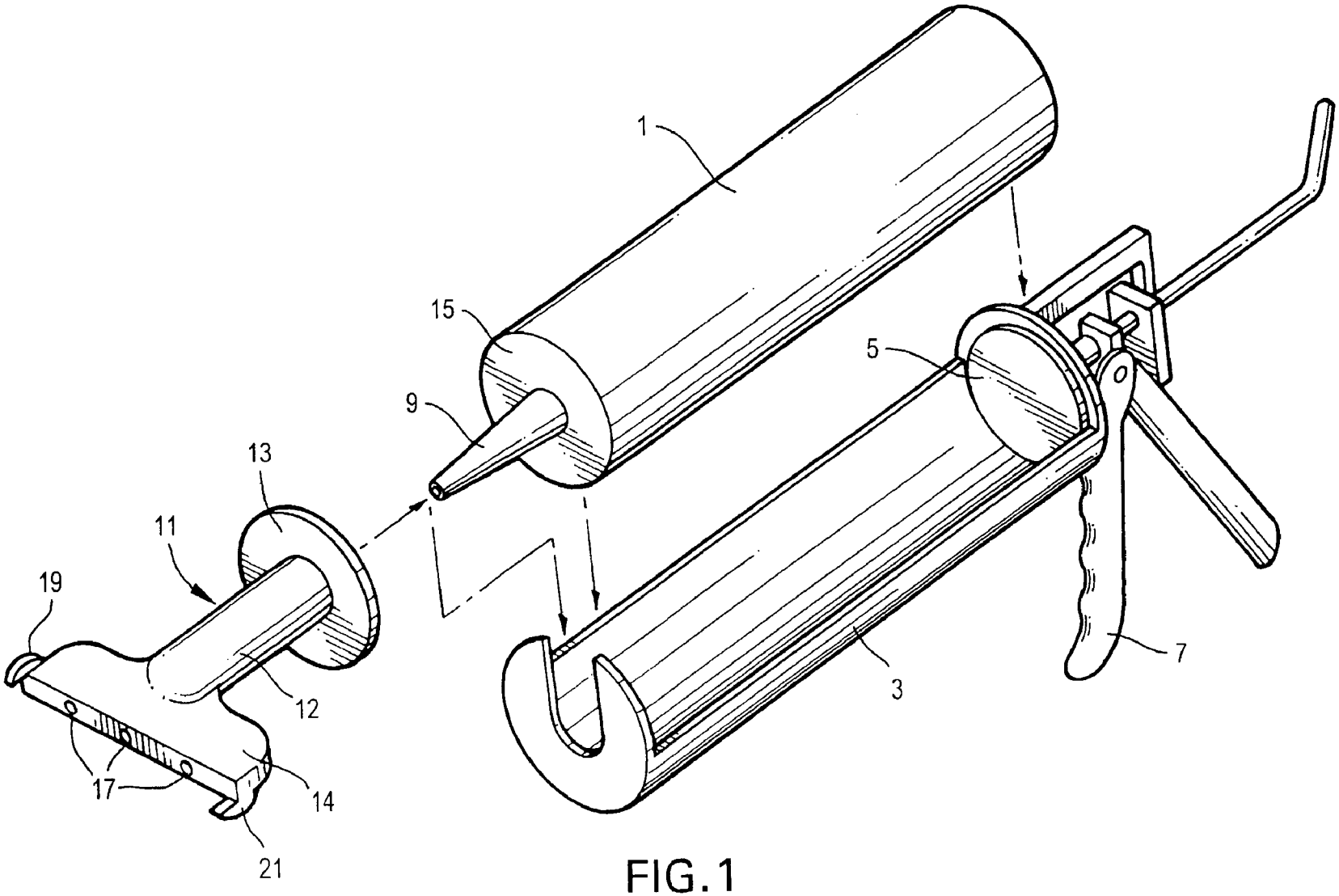
FIG. 1 provides an exploded perspective view of a caulking gun having a tip made according to the present invention.

FIG. 1 provides an exploded perspective view showing a caulking gun which has a tip made according to the present invention. The caulking gun includes a cartridge 1, which is filled with a material (such as an adhesive compound) to be extruded, and a housing 3, which includes a plunger 5 operated by handle 7. The cartridge includes a tapered outlet conduit 9 which allows the material to exit the cartridge upon the application of compressive force. The conduit 9 fits into a cavity (not visible in the view of FIG. 1, but shown in dotted outline in the view of FIG. 2) formed in the shank 12 of the tip 11.

The tip 11 includes a flange 13, the shank 12, and an outlet portion 14. The shank hollowed sufficiently to define the cavity which allows the tip to be inserted over conduit 9. When the tip is fully inserted, the flange abuts surface 15 of the cartridge. Material extruded from the conduit 9 flows through internal channels within the outlet portion 14 of the tip, and exits the tip through spaced-apart holes 17.

The tip 11 includes guides 19 and 21, located at opposite lateral edges of the tip. As shown in FIG. 1, the outlet portion 14 of the tip defines a generally planar surface; in the figure, only the upper surface is visible, but a similar surface exists on the opposite side of the outlet portion. In the view of FIG. 1, guide 19 extends above the plane of the upper surface, and guide 21 extends below the plane of the lower surface. Thus, the guides extend outside the planes of the upper and lower surfaces of the outlet portions of the tip.

The guides have a thickness which is small compared to the width of the outlet portion of the tip. For example, the width of the outlet portion may be at least ten times, and preferably twenty times, the thickness of the guide. While the thickness of the guide is not critical, it should be large enough that the guide can reliably engage an edge of a base or a base board, as will be described below, and small enough so that it does not interfere with the dispensing of compound through the outlet holes.

Figure 2:
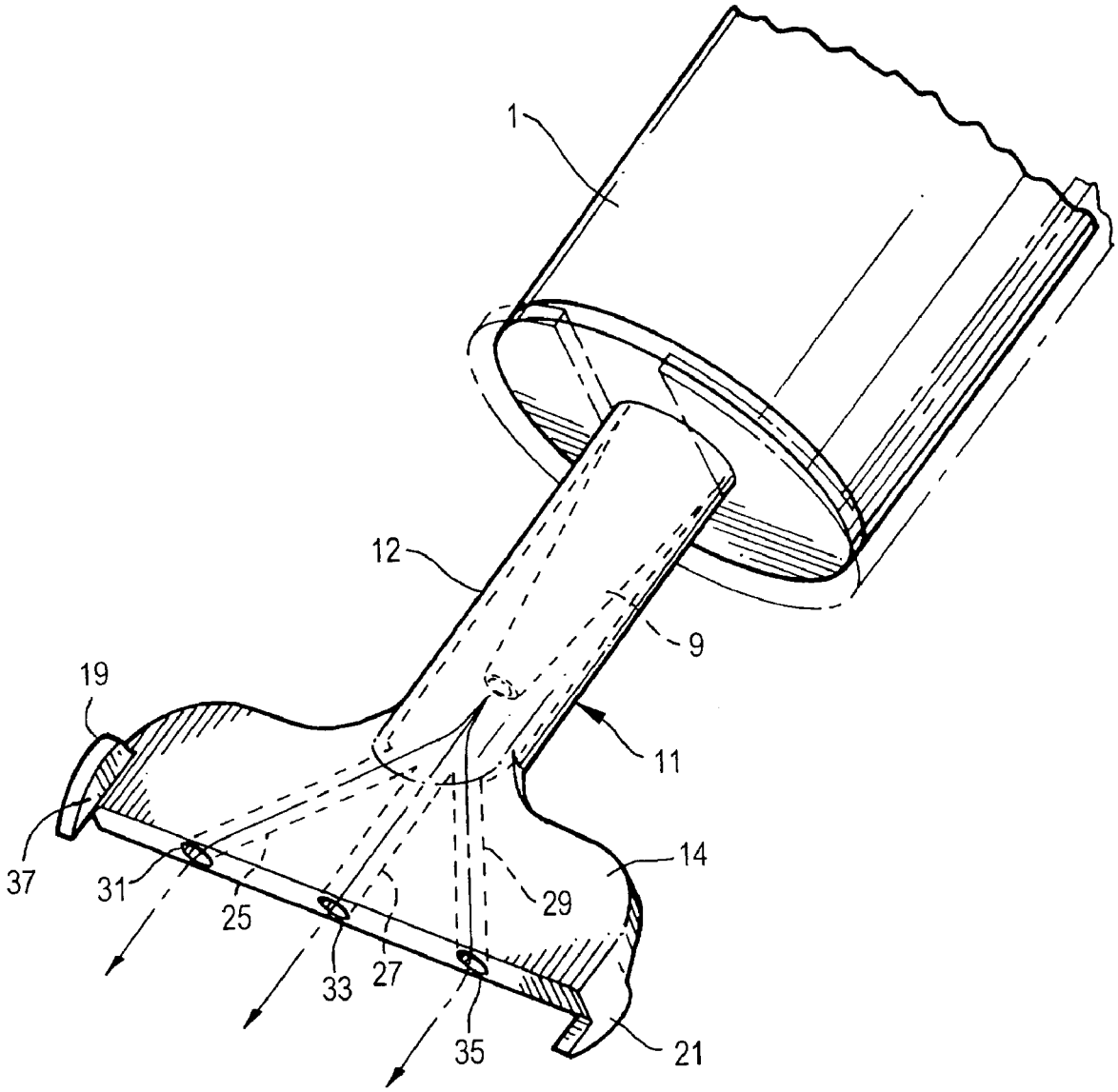
FIG. 2 provides a fragmentary perspective view, showing details of the tip made according to the present invention.

FIG. 2 shows more details of the construction of the tip 11. FIG. 2 shows the shank of the tip 11 fully inserted over the outlet conduit 9 of the cartridge 1. The tip, which is preferably formed of molded plastic, includes internal channels 25, 27, and 29, which define a manifold for distributing compound ejected from the cartridge. The compound exits the outlet portion 14 through openings 31, 33, and 35.

The invention is not limited to a particular number of openings. In general, there could be more or fewer openings, but it is preferred that there be enough openings to spread an effective quantity of compound onto a base or a base board, such that when the base or base board is pressed against a wall, the adhesive bond will be firm and uniform.

It is also important that the uppermost opening be positioned below the top edge of the base or base board, so that adhesive is not laid down too close to that top edge.

As is shown both in FIGS. 1 and 2, at least a portion of each of the guides 19 and 21 lies outside the plane of the outlet portion of the tip. In the embodiment shown, each guide has a curved edge that adjoins a generally planar wall, such as wall 37, for example. The walls of the guides are generally perpendicular to the plane of the corresponding surface of the outlet portion 14 of the tip. That is, wall 37 is generally perpendicular to the plane of the upper surface of the outlet portion, as shown in FIG. 2, and a similar wall defining guide 21, but which is not visible in the views of FIGS. 1 and 2, is generally perpendicular to the plane of the lower surface of the tip. The two guides are thus disposed symmetrically, and point in mutually opposite directions.

Figure 3:
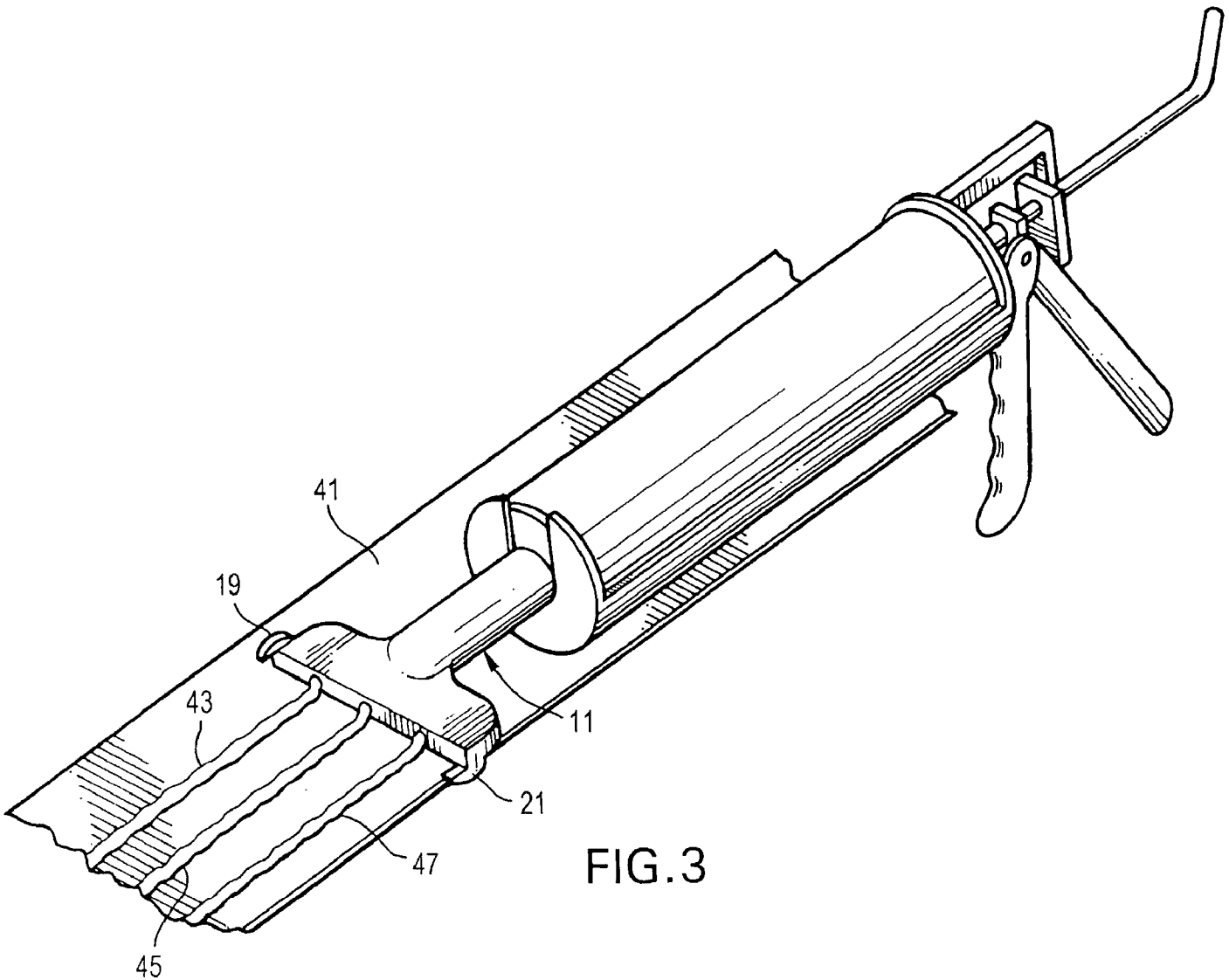
FIG. 3 provides a perspective view, showing the present invention being used to apply adhesive to an elongated structure such as a base.

The purpose of the guide is to align the tip along a base or base board, and to maintain the desired alignment as the caulking gun and tip are moved along the base or base board. The use of the guide is best illustrated in FIG. 3, which shows an adhesive or other compound being extruded onto an elongated structure such as a base. In particular, FIG. 3 shows base 41, and tip 11 being used to form tracks 43, 45, and 47 of adhesive or other compound. As shown in the figure, guide 21, having a wall that is generally perpendicular to the surface of the tip that abuts the base 41, engages the edge of the base. As long as the user moves the caulking gun and tip assembly along the base so that the guide remains in firm abutment with the base, the tracks of adhesive will be substantially straight, and will maintain their relative spacing indefinitely, along the length of the base. Thus, the user need not "aim" the caulking gun so as to position the adhesive; the user need only take care that the guide 21 remains in firm abutment with the edge of the base.

When the caulking gun is used in the orientation shown in FIG. 3, the guide 19 has no function. Only one guide is used at one time. The reason for providing a second guide is to enable the tip and/or the caulking gun to be used in different orientations. Thus, due to the presence of the two guides oriented in mutually opposite directions, one may insert the guide in either of two possible orientations, and the result will be the same. Moreover, the arrangement shown enables the user to invert the caulking gun without having to change the orientation of the tip, while still enjoying the advantages of the invention.

Figure 6:
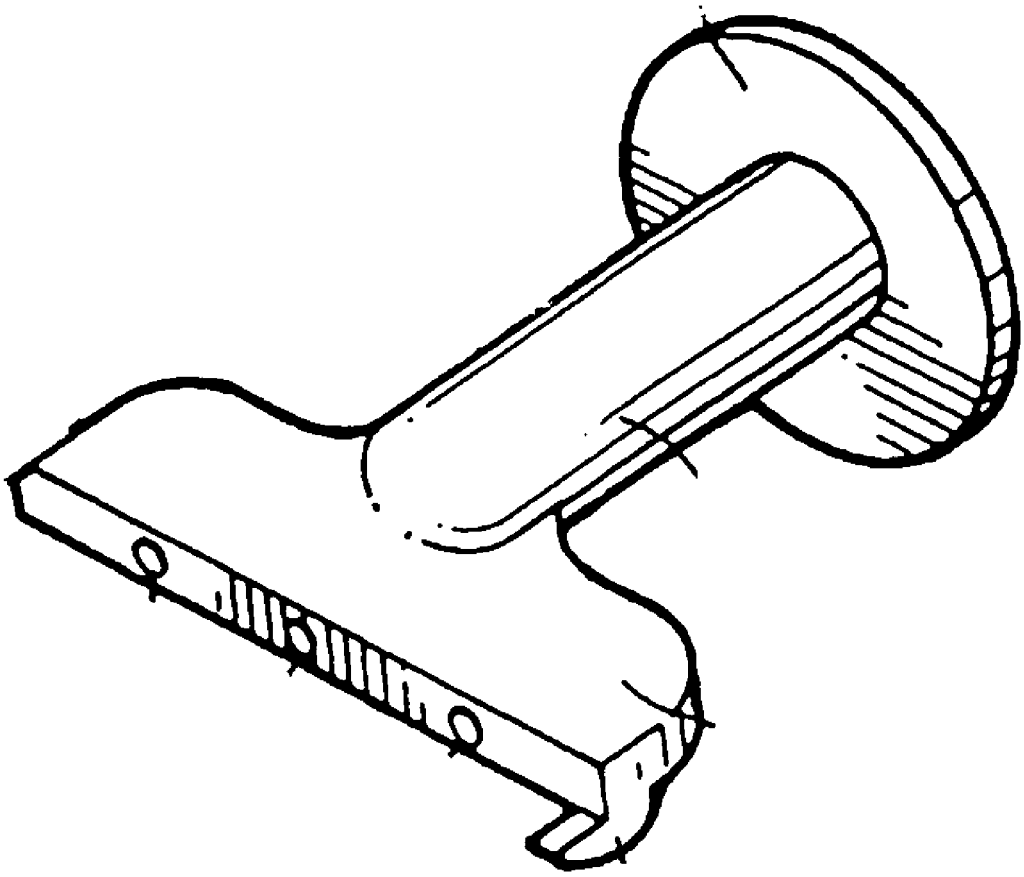
FIG. 6 provides a perspective view of an embodiment of the present invention wherein the tip has only one guide.

It is therefore possible to provide the tip with only one guide, located at one edge, as illustrated in FIG. 6. This alternative is intended to be included within the scope of the present invention. If the tip has only one guide, however, the orientation of the tip does become important, and one must be sure that the guide is positioned to abut the desired edge of the base.

It should be apparent, from the figures, that the exact shape and orientation of the guide or guides can be varied. In the most general form of the invention, the guide can be almost any structure which is non-coplanar with the surfaces of the outlet portion of the tip. This non-coplanar relationship insures that the guide will define a means for engaging an edge of the base or base board, while the surface of the tip abuts the surface to which adhesive is to be applied.

In another general formulation of the invention, one could simply provide a guide having a wall whose surface is non-parallel to the surface of the outlet portion of the guide. Such an arrangement would also provide means for enabling engagement of the guide with an edge of the base or base board. Although the perpendicular relationship of the side wall of the guide and the surface of the tip is preferred, it is not absolutely necessary, and the side wall could be disposed at a different angle.

Figure 4:
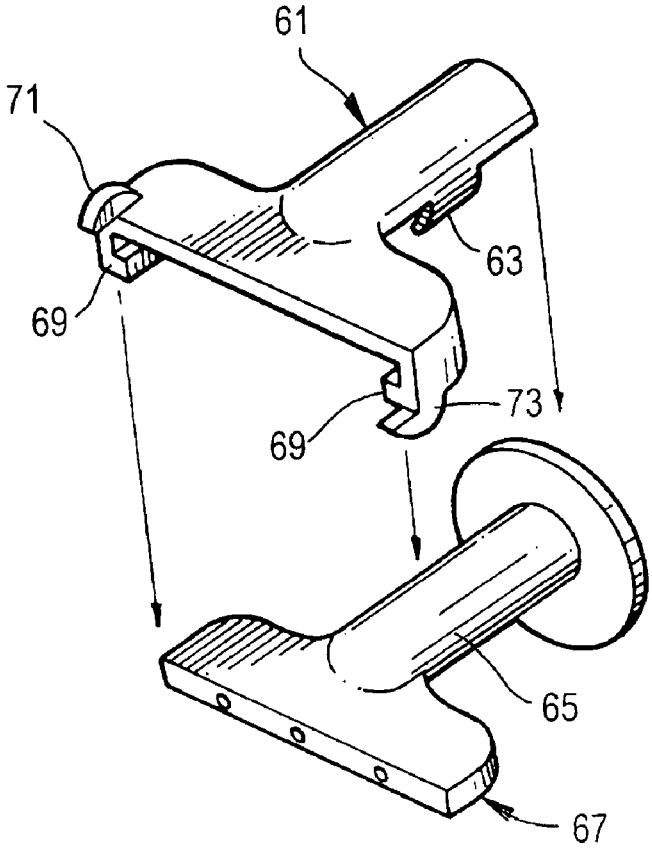
FIG. 4 provides a perspective view of another embodiment of the present invention, wherein a prior art tip is modified to include the present invention.
Figure 5:
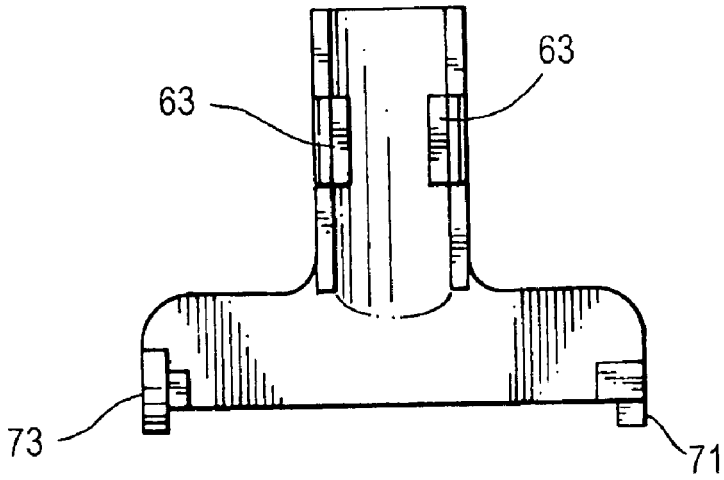
FIG. 5 provides a bottom view of an assembled version of the structure of FIG. 4, wherein a clip-on tip of the present invention has been attached to a tip of the prior art.

FIGS. 4 and 5 show another embodiment of the present invention, wherein a tip of the prior art can be effectively converted into a tip of the present invention. In this embodiment, an attachment is provided which includes the guides described above. The attachment is designed to clip onto a conventional caulking tip.

In FIGS. 4 and 5, the clip-on attachment 61 includes clips 63 for grasping the shank 65 of conventional tip 67, and clips 69 for engaging the lateral edges of the conventional tip. The attachment 61 also includes guides 71 and 73, which are similar to the guides shown in the previous figures. The conventional tip 67 already includes appropriate internal channels (not visible in FIGS. 4 and 5) which allow passage of the extrudable material through the exit holes in the tip. When the attachment 61 is installed, the conventional tip is effectively provided with guides which function exactly as described with respect to the embodiment of the preceding figures.

The exact configuration of the clip-on attachment is not critical. Other arrangements could be used. What is important is that the attachment include one or more guides, such that when the attachment is fitted onto a conventional tip, the resulting structure becomes the equivalent of the present invention as shown in FIGS. 1–3. The same result may be achieved with a different combination of clips. It is also possible to provide an attachment which is glued to the conventional tip. One could even simply affix, by adhesive means or otherwise, a guide onto an edge of a conventional tip.

It should be noted also that the tips of the prior art do not necessarily resemble the tip 67 in every respect. For example, in FIG. 4, it is seen that the surfaces of the outlet portion of the tip are parallel to each other, and that the cross-section of the outlet portion is generally rectangular. Some tips of the prior art provide corresponding surfaces that are non-parallel, wherein the cross-section is V-shaped, the surfaces joining at or near the location of the openings. The concept of the present invention is still the same, namely the provision of a guide, on one or both edges of the tip.

The present invention has substantial advantages over the prior art. The tip of the present invention enables construction personnel to apply an adhesive, or other compound, to an elongated structure such as a base or a base board, more rapidly than is possible with prior art devices. Moreover, the tip of the present invention virtually insures that the adhesive, or other compound, will be laid down accurately, and with consistency. That is, the adhesive will be laid down in neat, straight rows every time, as long as the user holds the guide firmly against the edge of the base or base board while moving the caulking gun. Thus, the uppermost row of adhesive will always be spaced by the desired distance from the top edge of the base or base board, and the problem caused by oozing of excess adhesive is eliminated.

The invention is not limited by the width of the outlet portion of the tip. The tip of the present invention can be made in various widths to accommodate various standard sizes of bases or base boards. Flexible bases are frequently provided in widths of about four inches, and the tip could be sized accordingly. Bases also can have a width of two inches or six inches, or some other width, and the tip can be sized to accommodate any of these possibilities.

The invention is not necessarily limited to the use described above, i.e. the application of adhesive to bases or base boards. The invention can be used in any context where it is desired to apply an extrudable compound to an elongated structure, in a manner such that the compound must be laid down in consistently straight lines.

The invention can be modified in various other ways. The number of outlet openings, and the configuration of internal channels of the tip can be changed. The exact shape of the guides can be altered. The manner of attachment of the clip-on embodiment can be changed also. These modifications, and others which will be apparent to those skilled in the art, should be considered within the spirit and scope of the following claims.

What is claimed is:

1. In a caulking gun, the caulking gun having a container filled with an extrudable material to be dispensed, means for forcing the material out of the container, and a tip, the tip being configured to receive the material being ejected from the container and to distribute the material through a plurality of spaced-apart openings formed in an outlet portion of the tip, the tip having a pair of lateral edges defining a width of the outlet portion of the tip, the outlet portion of the tip including upper and lower surfaces which are generally parallel to each other, the improvement wherein the tip includes first and second guides, the guides being located at said lateral edges, wherein said first guide extends above said upper surface and does not extend below said lower surface, and wherein said second guide extends below said lower surface and does not extend above said upper surface, wherein said first and second guides are oriented in mutually opposite directions.

2. The improvement of claim 1, wherein said first guide includes a first generally planar wall, wherein the first planar wall defines a surface which is generally perpendicular to said upper surface, and wherein said second guide includes a second generally planar wall, wherein the second planar wall defines a surface which is generally perpendicular to said lower surface.

3. The improvement of claim 1, wherein the guides are of equal thickness, and wherein the width of the outlet portion of the tip is at least ten times greater than said thickness.

4. A tip for a caulking gun, comprising:

a) a shank defining a passage for extrudable material, b) an outlet portion, connected to the shank, the shank defining a fluid passage which is in communication with a plurality of passages formed in said outlet portion, the passages terminating in a plurality of spaced apart openings, the outlet portion including two lateral edges and upper and lower surfaces, extending between said lateral edges, said upper and lower surfaces being generally parallel to each other, and c) first and second guides, the guides being located at said lateral edges, wherein said first guide extends above said upper surface and does not extend below said lower surface, and wherein said second guide extends below said lower surface and does not extend above said upper surface, wherein said first and second guides are oriented in mutually opposite directions.

5. An attachment for use with a conventional caulking tip, the conventional caulking tip comprising a shank connected to an outlet portion, the outlet portion including a plurality of internal channels which terminate in a plurality of spaced-apart openings, the attachment comprising a body having clips for attachment of the body to the conventional tip, the body having upper and lower surfaces which are spaced apart to define a thickness of the body, the body having a pair of lateral edges defining a width of the body, the width being greater than said thickness, the body having a guide which is located in a vicinity of only one of said lateral edges, wherein another of said lateral edges is free of any guide, and wherein the guide extends outside a plane of one of said surfaces.

6. An attachment for use with a conventional caulking tip, the conventional caulking tip comprising a shank connected to an outlet portion, the outlet portion including a plurality of internal channels which terminate in a plurality of spaced-apart openings, the attachment comprising a body having clips for attachment of the body to the conventional tip, the body having a pair of lateral edges and upper and lower surfaces, the upper and lower surfaces being generally parallel to each other, the body having first and second guides, said guides being located at said lateral edges, wherein said first guide extends above said upper surface and does not extend below said lower surface, and wherein said second guide extends below said lower surface and does not extend above said upper surface, wherein said first and second guides are oriented in mutually opposite directions.

7. A method of applying an extrudable material to an elongated structure, comprising:

a) providing a tip having an outlet portion defining upper and lower surfaces, the surfaces being generally parallel to each other, the tip having first and second guides connected to lateral edges of the tip, wherein said first guide extends above said upper surface and does not extend below said lower surface, and wherein said second guide extends below said lower surface and does not extend above said upper surface, wherein said first and second guides are oriented in mutually opposite directions, b) connecting the tip to a caulking gun, c) selecting one of said first and second guides, and engaging the selected guide with an edge of an elongated structure, and d) extruding a material from the caulking gun while moving the tip along the elongated structure, while holding the selected guide in engagement with the edge of the elongated structure.

8. The method of claim 7, further comprising the step of reversing an orientation of the tip so as to select another guide which is different from the guide selected in step (c), and performing step (d) with said another guide in engagement with the edge of the elongated structure.

* * * * *